United States Patent [19]

Druss

[11] 4,026,045

[45] May 31, 1977

[54] BOOT SOLE STRUCTURES

[75] Inventor: Barry L. Druss, Holliswood, N.Y.

[73] Assignee: Chimera R. & D., Inc., Holliswood, N.Y.

[22] Filed: Dec. 3, 1975

[21] Appl. No.: 637,824

[52] U.S. Cl. ..... 36/108

[51] Int. Cl.[2] ..... A43B 23/00

[58] Field of Search ..... 36/91, 107, 117, 136, 36/108

[56] References Cited

UNITED STATES PATENTS

| | | | |
|---|---|---|---|
| 2,588,919 | 3/1952 | Gredell | 36/136 |
| 3,775,875 | 12/1973 | Dvorsky | 36/117 |
| 3,925,911 | 12/1975 | Erlebach | 36/117 |

*Primary Examiner*—Patrick D. Lawson
*Attorney, Agent, or Firm*—Tab T. Thein

[57] ABSTRACT

Boot or footwear sole structures and assemblies adaptable to various conditions where components are fixed to the sole between the heel and the toe portions of the boot by the forced interaction of opposed bearing surfaces on the components, with supporting areas or bearing profiles formed in the sole on respective sides of an opening that is provided between the heel and toe portions. The components stiffen the sole when assembled, and in addition portions thereof can be specially adapted for particular uses, such as climbing spikes, ice crampons, skates or ski bindings, thereby giving the boot sole structures varied adaptability and interchangeability to various modes of activities.

15 Claims, 17 Drawing Figures

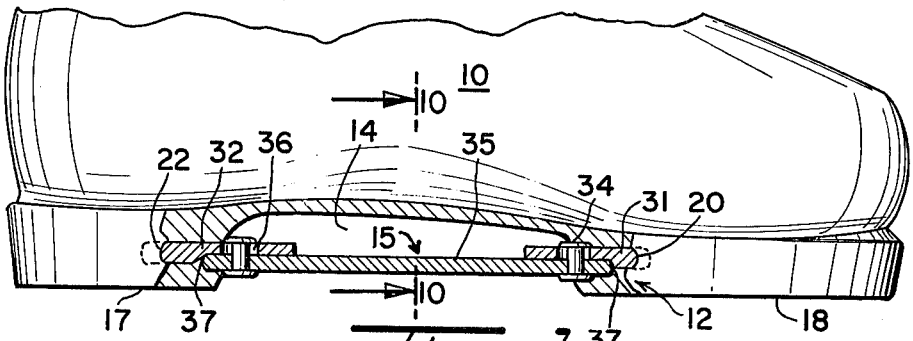
Fig. 1.
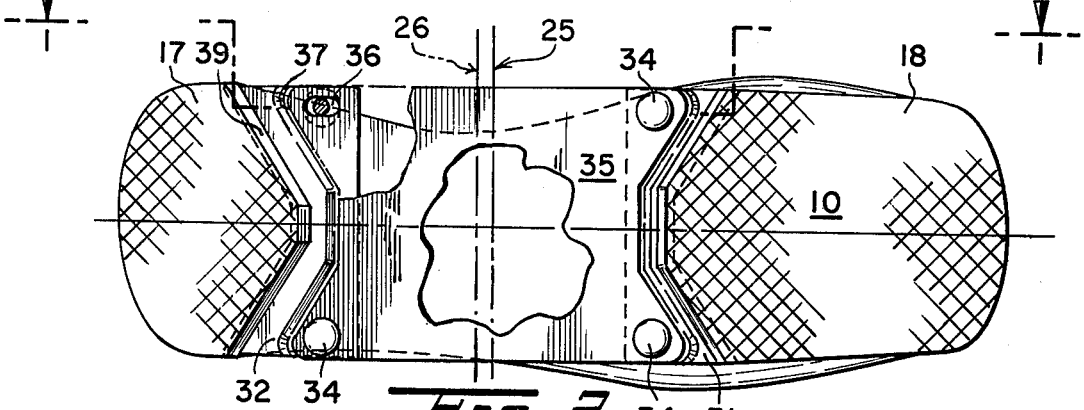
Fig. 2.
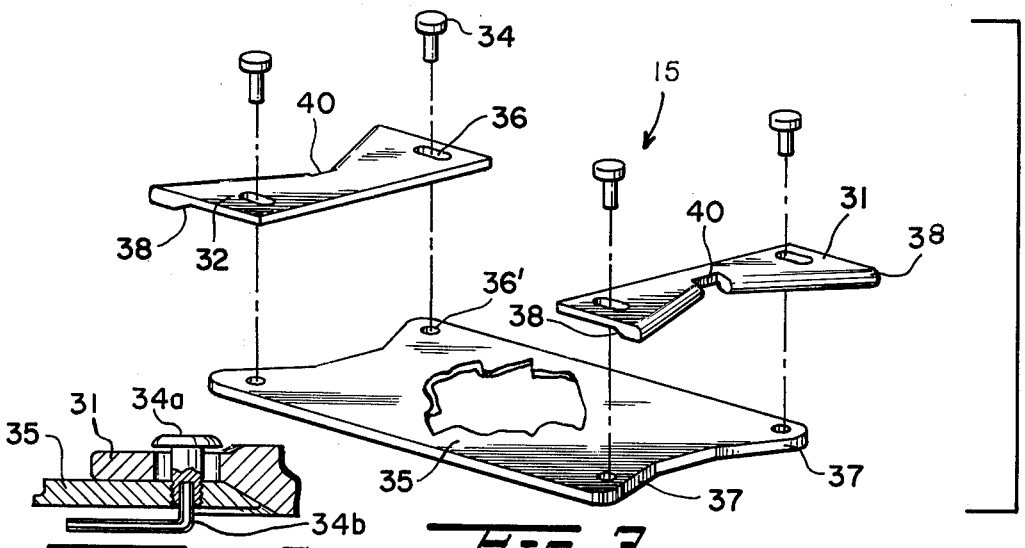
Fig. 3.
Fig. 4A.
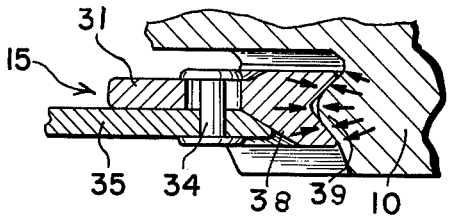
Fig. 4.
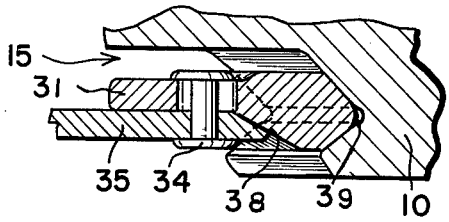
Fig. 5.

BOOT SOLE STRUCTURES

Footwear sole structures with components fixed in an opening of the sole, wherein the interaction of the components with the sole is achieved by means for bracing them against support surfaces on opposite sides of the opening, also allowing particular attachments to be used, such as crampons, spikes, parts for skates or ski bindings, and the like.

There is a need for footwear to serve many different purposes in addition to the mere protection of the wearers' feet and to facilitate walking. For use on terrain and for special activities, the participants can either wear footwear that is especially suited for the situation or add components to a suitable footwear or boot in order to serve that special purpose.

As an example, a skater can either use a shoe that is made with and for a skate; or the participant can adapt a skate mechanism to an existing shoe. Another example is a mountaineer who attaches crampons to climbing boots when using them on ice and snowy terrain. A further example is a pole climber who attaches a spike to the instep area of his boot to permit climbing capability.

Usually footwear designed for special purposes (i.e. skating, skiing, mountaineering, climbing) is superior in performance to the general-purpose shoe or boot used with special adaptive components, and having a similar function.

Thus it is one of the objects of the present invention to permit general-purpose footwear to compare favorably performancewise with the special-purpose footwear in certain cases, and also to be specially suited to engage components wherein general-purpose footwear cannot.

It is one of the major features of the invention to stiffen the sole action of footwear when the novel components are added to the sole in an arch area thereof (or conversely to soften the sole action when the components are removed).

This is applicable in mountaineering, when moving from flat terrain, that requires flexible sole action for a good striding gait, to steep rocky terrain, wherein a rigid sole is necessary from the ball of the foot area to the heel, to provide good lateral supporting sole action for balancing maneuvers on rock and other small-platform areas.

The invention alters the boot sole to fit a special condition without damaging the same. In the case of a ski boot, where the ski shop mounts binding plates onto the sole by screws, this alteration possibly allows moisture to enter the sole through the screw holes, which may be left exposed when the binding plates are removed during a change-over to another binding.

In addition, the invention does not require special skills or tools to make modifications to the sole, and alterations can be accomplished as desired. The sole is designed for the interfitting with components having opposed bearing surfaces that are suited for interaction. The interfitted components can be recessed into the arch area which then protects them from added wear.

The invention can be used for many purposes, wherein boots can be adapted to hiking (without interfitting components), rock climbing, movements on ice (with crampons), rope climbing, skiing (with suitable binding portions for both), alpine and cross-country touring, even during the course of a single trip, and all without the need to remove the boots from the users' feet, if so desired, through all these different activities.

In accordance with major features of the invention, a boot sole structure is provided, mainly for stiffening the sole, but optionally also for fixing the earlier-described auxiliary attachments to the sole of the boot, between the heel and toe portions thereof, whereby to adapt the boot for the mentioned particular uses. The structure essentially comprises a bracket assembly secured to the boot in its arch area, including at least two relatively moveable and reciprocable bearing members that can be braced against corresponding support surfaces of the sole, and means for interlocking the bearing members in their assembled condition.

The bearing members interact with one another during the assembly, and in the assembled interconnection, at their respective contact surfaces by either a pivotal or a sliding action.

The bearing members may be constituted by at least one, possibly two, central bracket members, and two longitudinally engageable bearing brackets. If two bracket members are used, they straddle the brackets which partly protrude therebetween. However the bearing members can also be constituted by a pair of the bearing brackets, which latter are preferably fitted with longitudinally interengageable protruding portions.

The bearing members can be longitudinally or transversally provided in the assembly. Other optional features will become better understood as the description proceeds.

Other objects and many of the attendant advantages of the invention will be readily appreciated as the same becomes better understood by reference to the following detailed description, when considered with the accompanying drawings, wherein FIG. 1 is a side view of an exemplary boot sole structure according to the invention, partly sectioned, and taken along line 1 — 1 of FIG. 2, shown together with portions of an associated boot;

FIG. 2 is a bottom view of the structure shown in FIG. 1;

FIG. 3 is an exploded view of bracket assembly components as used in FIGS. 1 and 2;

FIG. 4 is a partial, somewhat enlarged cross-sectional view of the end of the assembly as it fits against the boot sole which has a substantially concave bearing surface or portion;

FIG. 4A is a modification of the assembly end shown in FIG. 4, exemplifying a removable threaded bolt for assembly and re-assembly of the sole structure in the field;

FIG. 5 is a cross-sectional view similar to that of FIG. 4 but where the end of the assembly has a substantially convex bearing surface or portion;

Figure 15:
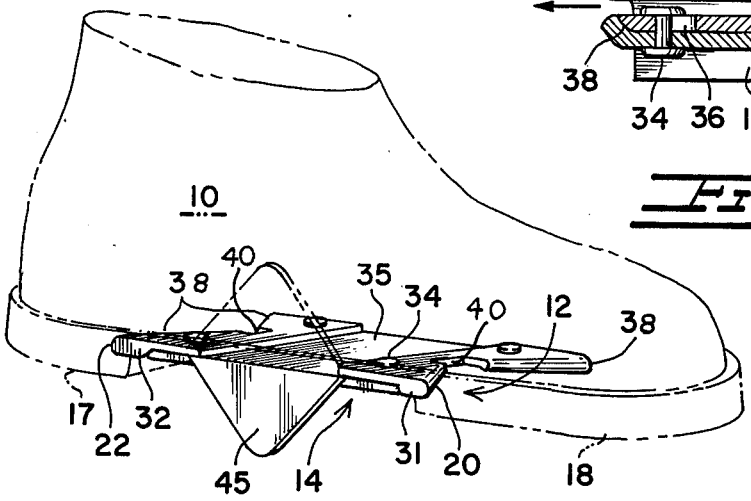
Figure 16:
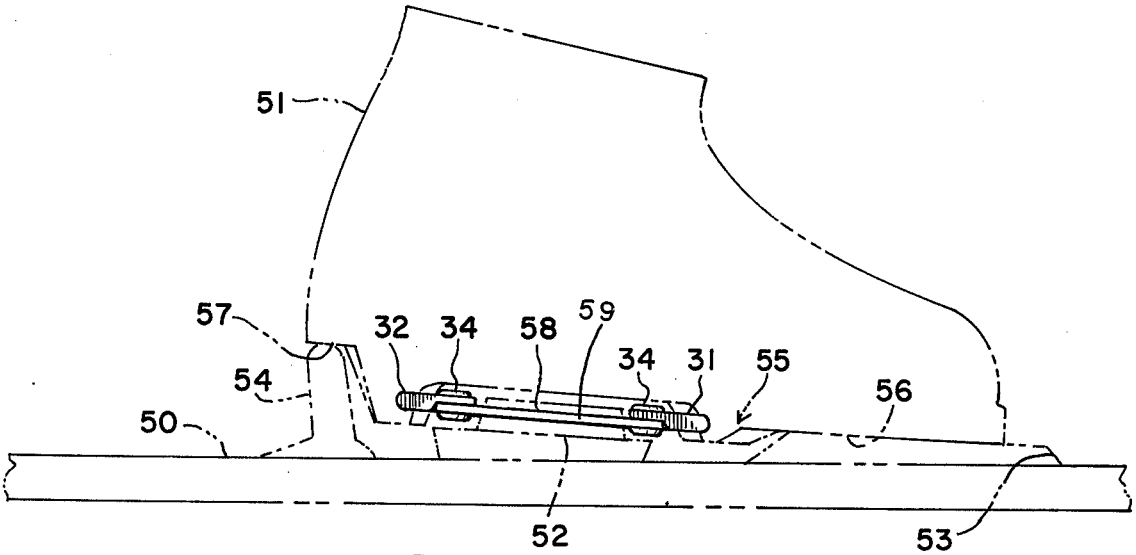

FIG. 15 is a somewhat schematic exemplary illustration of one possible use of an inventive boot sole structure embodiment, namely in conjunction with a removable spike portion for climbing; and FIG. 16 is another example of using the inventive structure, this time in connection with a ski and interposed portions of a ski binding, partly associated with the boot sole structure; all the extraneous parts (boots, soles, etc.) in the last two figures being shown in phantom since they do not constitute parts of the invention.

FIGS. 1 and 2 show in respective side and bottom views an exemplary boot sole structure according to the present invention, attached to a boot 10 that has a sole portion 12, and in a central recessed arch area 14 the inventive structure or bracket assembly itself, generally designated by numeral 15. In a known manner, the sole 12 has a heel area 17 and a ball of foot / toe area 18. The arch area 14 is relatively open to accommodate front and rear supporting portions 20, 22 with a separating portion 21 therebetween. The latter as well as support surfaces 23, 24 on the portions 20, 22, respectively, will be explained somewhat later in connection with FIGS. 10 to 12.

The supporting portions 20, 22 are V-shaped and outwardly angled, away from the center of the arch area 14, so as to fix the members of the bracket assembly 15 in a horizontal planar axis, both longitudinally and laterally relative to the boot 10. It should be understood that this V configuration for the portions 20, 22 can be altered to be inwardly angled, to have a curved configuration, or a U form (either of them being illustrated), all serving the same function of securing the structure 15 in the horizontal planar axis. Further explanations will be given subsequently in these regards.

It should be understood that the normal axis of the assembly can vary with respect to the relative positioning of the sole support surface to the boot itself and that the horizontal planar axis is a convenient coordination, which is not to be assumed as most desirable in practice.

The bracket assembly 15 includes front and rear bearing brackets 31, 32, which cooperate with a central bracket member 35. It can be seen from FIG. 3 that suitable fasteners or bolts 34 can be passed through elongated slots 36 of the brackets 31, 32 and corresponding holes 36' of the member 35. The slots allow adjusting movement while the holes immobilize the assembly. When assembled, the member 35 holds the longitudinally oriented brackets 31, 32 by means of the fasteners 34 that can be bolted, riveted, welded or otherwise connected if a permanent connection is desired (the arch area 14 allows sufficient room for any tool portion to be inserted for this purpose).

FIG. 3 shows an exploded view of the assembly 15, including contact surfaces 37, 38, respectively, on the member 35 and on the brackets 31, 32, which surfaces act to wedge the brackets forwardly and rearwardly with sufficient force against the supporting portions 20, 22 during assembly of the fasteners 34. Clearance notches 40 are shown in FIGS. 3 and 15 in outwardly, central areas of the bearing brackets 31, 32.

In FIGS. 4, 5 the brackets 31, 32 are shown with respective concave and convex bearing profiles 39 for rigid engagement of the supporting portions 20, 22 therewith. Similar conditions exist at the other end of the bracket member 35, as can be visualized in the leftward sectioned portion of FIG. 1.

The supporting portions 20, 22 on the sole 12 have in the vertical plane substantially concave (FIG. 5) or convex (FIG. 4) profiles which serve to secure the bracket assembly 15 in a position vertically relative to the normal axis achieved horizontally by the assembly.

In FIGS. 4, 5 the sides can be flat at the tops and bottoms of the bearing profiles 39 while the supporting portions 20, 22 on the sole 12 will deform to fit the profiles, preferably leaving a slight amount of space between the sides as well as the top and the bottom.

FIG. 4A shows a removable, modified fastener or bolt 34*a* that can be at least partly attached and removed by means of a conventional tool, such as shown at 34*b*, even in the field, when the wearer of the inventive boot sole structure wishes to change or modify the same, such as when switching from one activity to another.

It should be noted that the embodiment of FIG. 4A need only be used on one side of the bracket assembly 15 of FIGS. 1 to 3 to achieve the change or modification of the assembly, and that the attachment of the brackets 31, 32 to the bracket member 35 on the other side can be made permanent.

In FIGS. 1 through 3, the rear bracket 32 is somewhat longer than the front bracket 31 so as to locate a central transverse axis of the central member 35 forward of a similar axis of the arch area 14, as shown in FIG. 2. This enables the wearer to use the member 35 in two distinct operational positions by locating the same forward or rearward, as desired, longitudinally relative to the boot 10, when required for one use or another. As a matter of example, skiing might require separate longitudinal positions for the boot on the ski, as an option to provide a different weighted position for the user under differring skiing methods or conditions. In FIG. 2, this is schematically indicated by two transversal center lines, 25 and 26, relative to the two possible positions of the member 35.

The assembly members 15 are recessed in the arch area 14, which serves to protect these members from tread wear. The arbitrary cut-out in the member 35, shown in FIGS. 2 and 3, simply denotes an area where additional parts or members might be attached, as will be explained later in connection with the exemplary uses shown in FIGS. 15 and 16. The assembly 15 acts to brace the center of the sole 12 from the heel 17 to the ball 18 of the foot, substantially stiffening sole action as against the unassembled condition.

The footwear can be so structured across the arch area to allow a limited amount of torsional movement, longitudinally between the toe / ball of the foot and the heel, without any appreciable bending movement coincident to same. A suitable reinforcement built into or across the arch of the sole can accomplish this goal.

It should be understood with reference to FIGS. 1, 4 and 5 that the pressure of the member 35 deforms the boot sole 12 slightly about the bearing surfaces 39. The latter are part of the members 31, 32 which contact the sole at the supporting portions or areas 20, 22. The latter deform to fit to the shape of the bearing surface 39 which is rigid. This creates a greater binding force, as shown in FIG. 4 by small arrows in the contact regions between the portions 20, 22 and the surfaces 39. The situation is of course similar in FIG. 5, only with differently shaped profiles on the bearing bracket 31, the central member 35 and/or the bearing surfaces or profiles 39.

FIGS. 6 through 9 are side views of exemplary bracket assemblies 15 in the pre-assembled condition, with arrows indicating the movements during installation in the sole (not shown here). In the first example, FIG. 6, the contact surfaces 37, 38 on the members 31, 32 and the central member 35 are substantially square to the top and bottom surfaces. In order to engage the components, the members 31, 32 have to be inclined (as shown by the arcuate arrows), in a downward direction, to allow the surfaces 38 to make angular contact with the edges of the appropriate opposing surfaces 37 of the member 35, thereby creating a pivotal movement at the outer edges of the member 35 along the contact surfaces 38 on the members 31, 32 during the engaging motion of the bracket assembly 15. It will be understood within the framework of these explanations that each of the exemplary structures shown in FIGS. 6 to 9 is assembled with and into the arch area 14 as was shown and explained in connection with FIGS. 1 to 5.

It is possible that the interlocking or interengaging action of the assembly 15 to the sole will not bring the contact surfaces 37, 38 entirely flush or substantially planar to one another. This would result in an angular relationship of the bearing bracket or brackets with respect to the central element, or one another, when engagement is achieved. It is also possible that only the pivoted ends of the contact surfaces 37, 38 on the respective members 31, 32 and/or 35 will interface with the surfaces of the opposing members, for final assembly and engagement of the structure to the sole.

Figure 6:
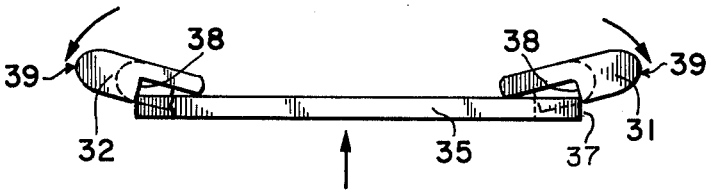
FIG. 6 is a side view of an exemplary bracket assembly in the pre-assembled condition, with arrows indicating the movement during installation in the sole (not shown)

In the embodiment of FIG. 6, the bearing profiles 39, being substantially convex in profile, can pivot about an axis around its interaction with the receptive supporting portions 20, 22 on the sole during engagement, and in addition this embodiment can be partially assembled at one side (bearing bracket 31 or 32 fastened to the central member 35) before being assembled to the sole.

Figure 7:
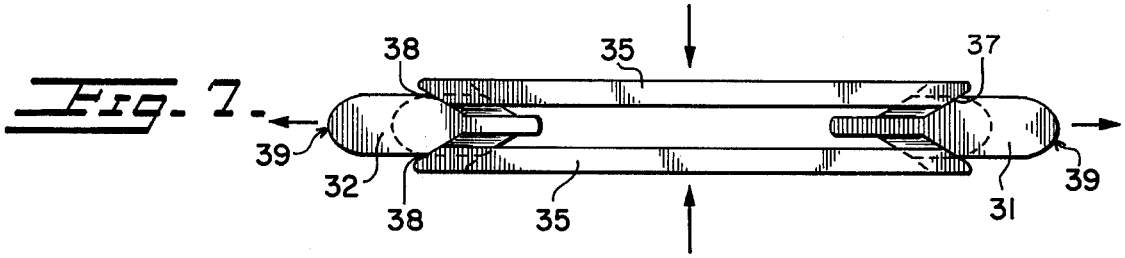
FIG. 7 is a side view of another bracket assembly which has two central brasket members.

In FIG. 7 the central member is in the form of two parallel portions 35, where the contact surfaces 37, 38 are inclined on both members 31, 32 on both portions 35, in a symmetrical arrangement, as shown. The portion above is moved downward, and the one below is urged upward, so that the members 31, 32 are forced outwardly when the portions 35 are united (bolts and the like not shown). Eventually the members 31, 32 achieve attachment to the supporting portions 20, 22 at the ends of the arch area 14 of the sole 12.

Figure 8:
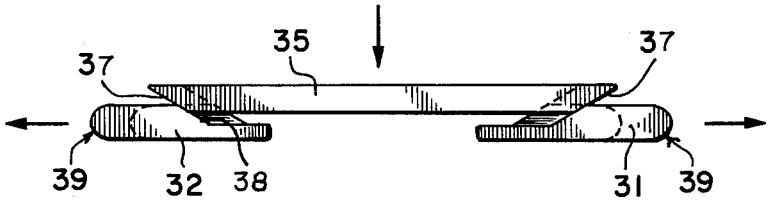
FIG. 8 is yet another assembly, the central bracket being positioned above a pair of oppositely movable brackets.

Yet another assembly is shown in FIG. 8, constituting a variation of the embodiment of FIGS. 1 to 3, wherein the central member 35 is positioned above two bearing members 31, 32, engaging them by a downward movement against respective inwardly inclined contact surfaces 37, 38 of these members. The illustrations will allow the observer to see how the movement of the central member 35, parallel with its own plane, forces the front and the rear brackets 31, 32 into sliding engagement with the supporting portions 20, 22.

Figure 9:
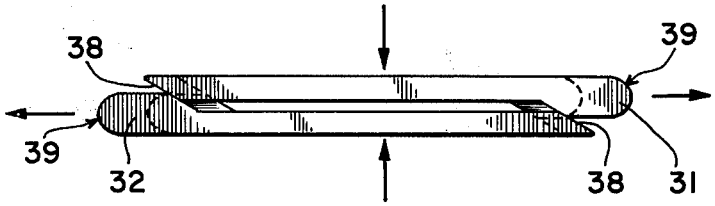
FIG. 9 is another bracket-assembly side view wherein the brackets have slanting contact surfaces different from those of FIG. 8.

Another bracket assembly 15 is shown in FIG. 9, constituting a further variation, wherein two bearing members 31, 32 are used which have elongated extensions, making the so far used central member (35) superfluous in this embodiment. The extensions have the inclined contact surfaces 37, 38 thereon to achieve engagement, as described before. The two bracket components when interfacing with one another fulfil the minimum requirements for engagement between the heel and the toes area of the sole structure.

By recapitulation it can be stated that FIG. 6 shows a pivotal engagement while the FIGS. 7 through 9 all show differently structured sliding connections between the respective members.

It might be added for the sake of completeness that only the surfaces 38 are identified in FIGS. 6 through 9 to simplify the illustrations; the cooperating surfaces 37 can be seen in FIG. 3. The bearing surfaces 39 describe portions of the members 31, 32 which bear against the sole at the support surfaces 23, 24 on the supporting portions 20, 22.

Figure 10:
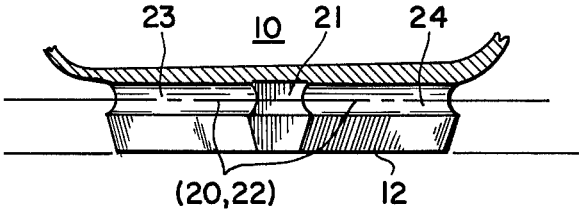
FIG. 10 is a partial cross-section through the arch area of a boot to which the inventive structure can be added (the structure itself having been omitted), for illustration of the supporting surfaces of the sole, taken along line 10 — 10 of FIG. 1.
Figure 11:
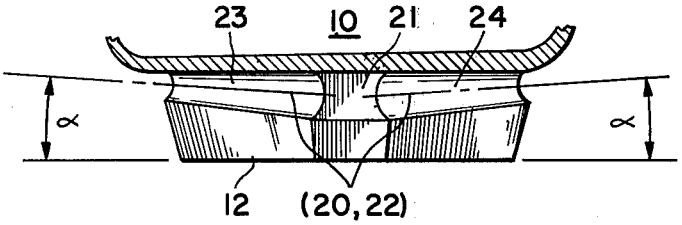
FIG. 11 is similar to FIG. 10 but relates to differently fashioned support surfaces.
Figure 12:
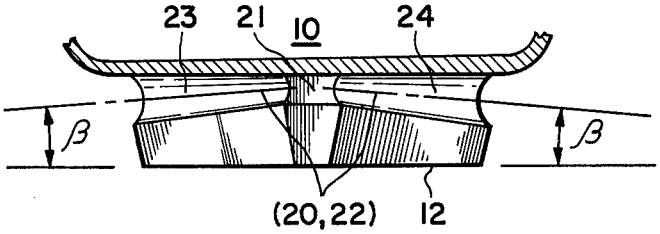
FIG. 12 is similar to FIGS. 10 and 11 but shows further modified support surfaces.

FIGS. 10 through 12 show variations of the supporting portions 20, 22 that are formed in the sole 12 at either the heel 17 and/or the toe areas 18. These figures show the earlier-mentioned separating portion 21 between the portions 20, 22, as well as the similarly mentioned left- and right-hand support surfaces 23, 24. These views are cross-sections through the arch area 14 of the boot, and are to be understood to relate to both the front and the rear areas, as signified by the combined use of the numerals 20 and 22.

These supporting portions 20, 22 determine the final positioning of the bracket assembly 15 relative to the shoe or boot in the assembled condition. Therefore it might be advantageous to locate these surfaces at an angle or at combined angles, longitudinally or laterally (not shown) to the sole 12, for the integration of various different component assemblies to the sole.

FIGS. 10 to 12 give three preferred possible alternatives for the portions 20, 22, namely substantially uniform across the sole 12, widening toward the central separating portion 21, and widening away from the latter, the latter two being identified by the respective angles alpha and beta in FIGS. 11 and 12. FIG. 10 shows two parallel lines, to denote a uniform distance across the sole.

These alternatives consist in that the normal axis of these surfaces can be oriented planar or parallel to the sole tread surface, as in FIG. 10, or upward, as in FIG. 11, or downward, as in FIG. 12. It should be understood that the condition of the support surface with regard to its shape is independent to the condition of the normal axis of the same.

FIG. 10 shows the general approach of the invention wherein the support surfaces 23, 24 are made with a continuous vertical height or profile from side to side, across the sole. In a horizontal profile, this results in a U shape. For ease of construction, however, a planar-sided V profile is preferred, namely to index or locate the bracket assembly 15 in position with regard to the horizontal planar axis of the structure.

The opposed V profile in the arch area 14 might tend to center the bracket assembly 15 along the longitudinal axis between the separating portion 21 and each of the support surfaces 23, 24. Therefore, for certain modes of operation, the invention also contemplates to locate the V profile arrangement at different positions laterally, for example in the making of the associated boot 10, so as to relocate the attached position of the members 15 along a possibly different longitudinal axis.

It can be added that the separating portion 21 fits into the clearance notch 40 without contacting the bearing bracket 31, 32 so as not to interfere with the displacement of the bearing surface 39 into or against the supporting portions 20, 22 on each side, right and left, of the separating portion 21.

By way of summary it can thus be stated that FIG. 10 shows the support surfaces 23, 24 to be normal in their areas, and substantially parallel with the walking surface of the hole 12.

FIG. 11 discloses the widening or tapering surfaces 23, 24, wherein the normal axes of these surfaces are slightly upwardly angled or inclined relative to the sole surface.

It is also possible to make the support surface areas wider at the center, next to the portion 21, than at the outer ends, or conversely, wider at the ends than at the center.

FIG. 12 finally shows an arrangement wherein the surfaces 23, 24 taper inwardly, thus becoming narrower or smaller at the center, and their axes are also downwardly angled, as shown. It will be understood that the smaller or narrower areas, at the outer ends and at the center, respectively, of the surfaces in FIGS. 11, 12 increase the gripping and engaging action when the brackets 31, 32 are inserted and the structure tightened for use.

It might be added for the sake of completeness that the boot sole 12 is able to be compressed slightly, being preferably formed of rubber or rubber-like thermoplastic or thermosetting materials such as, for example, polyurethane, which has desirable characteristics with regard to this invention, particularly in the support areas. The latter will thus deform to some extent around the bearing brackets so as to "grab" those components. The surface pressure in the bearing areas will tend to rigidify the sole, even beyond the bearing areas, in both forward and rearward directions.

Figure 13:
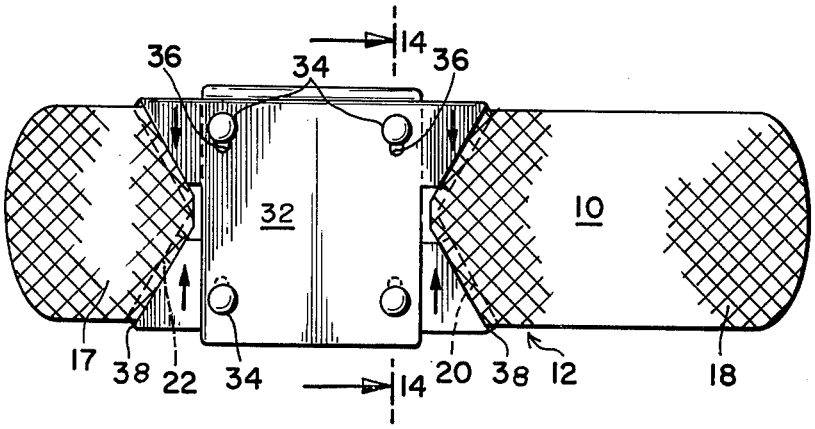
FIG. 13 is a bottom view similar to that of FIG. 2, with a modified bracket assembly applied to the sole of the boot.
Figure 14:
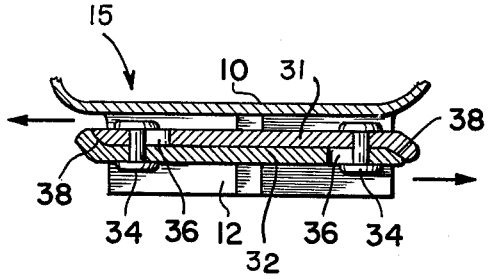
FIG. 14 is a transversal cross-sectional view of the assembly, taken along line 14 — 14 of FIG. 13.

FIGS. 13 and 14 show a modified bracket assembly, as applied to the sole of the boot 10. It has been clear from the preceding description that in all described embodiments of the inventive boot sole structure the engaging action is directed in opposite fore and aft directions, that is longitudinally of the FIGS. 1, 2 and 6 to 9. In the last embodiment, the action is directed in the FIGS. 13, 14 transversely to the sole, or laterally thereto. Again with the absence of a central bracket member, as was explained for FIG. 9, two appropriately shaped bearing brackets 31, 32 are used, one above the other, as can be seen from the sectional view of FIG. 14, and having both the terminal contact surfaces 38 that engage and hug the other ends 37 of the respective other bracket.

The fasteners or bolts 34, slots 36 and holes 36' (not identified in the latter figure) are similar to those described earlier. The members or brackets 31, 32 are forced inwards, towards one another, again with a sliding action, against the support surfaces of the sole. The bearing profiles or surfaces 39 with which the brackets 31, 32 engage (not shown) are on the same side of the boot 10, one facing forward and one rearward, for engagement of the brackets 31, 32 with the respective supporting portions 20, 22 (not shown) when assembled. Engagement is achieved by the welding of the terminal portions or surfaces of these members across one another, preferably at the opposite inclined surfaces, as shown, otherwise in a manner similar to that described for FIG. 9. The engagement by means of the fasteners 34, which may be removable as explained for FIG. 4A, is the same as described before in connection with the slots and the holes of FIG. 3.

For assembly considerations a clamping device and a welding method of fastening may be used between the brackets 31, 32 (with or without the member 35), to create a permanent attached condition if desirable (not shown). The elements numbered 12, 15, 17 and 18 would be held in such a device for performing the assembly in an otherwise known, conventional manner.

Two exemplary uses for the inventive sole structures are given in the remaining two figures, although there are many others such as attaching skates, ice crampons, and other fixtures or auxiliary attachments that have been associated, and may be associated in the future, with structures of the disclosed kind. It should however be emphasized that the main purpose of the invention is to stiffen the sole 12 or 55 of the boot 10 or 51 in the arch area 14, as was explained earlier.

As shown in FIG. 15, in addition to the already described sole structure, a tree or pole climbing spike portion 45 may be fastened to or made to form part of the central member 35, preferably on one side of the boot 10, as shown. The spike portion 45 can be reversed and assembled facing upward (shown in that part in phantom lines), preferably on the inside edge of the member 35 where the arch area 14 allows sufficient clearance.

FIG. 16 discloses another possible application for the inventive boot sole structures, namely in connection with a ski 50, a boot 51, and a centrally disposed binding mechanism generally designated by numeral 52. In a manner as has been disclosed in the inventor's earlier U.S. Pat. Nos. 3,727,932, 3,810,643 and 3,902,729, all relating to ski bindings, the mechanism 52 can be constituted by a so-called plug member that cooperates with interconnecting portions 59, for example in the form of a so-called socket member, forming part of or taking the place of the bracket member 35 that was described earlier.

For the sake of completeness, the ski-binding structure is supplemented in the exemplary illustration of FIG. 16 by front and rear pivots 53, 54, while a sole portion and a toe rest of the boot 51 are respectively shown at 55, 56; a heel rest 57 may engage the rear pivot 54. In the plug-and-socket structure 52 (35), 59, a central opening 58 may be provided, taking the place of or supplementing that which was explained for FIGS. 2, 3.

It should be understood that the scope of the invention can apply to all such boot—binding designs where there is need to fasten a mechanism to the sole of the boot, preferably in the center / arch area, for interconnecting with a matching structure on the ski. A typical known structure requires lateral attaching surfaces.

It should be understood, of course, that the foregoing disclosure relates only to preferred, exemplary embodiments of the invention, and that it is intended to cover all changes and modifications of the described examples which do not constitute departures from the spirit and scope of the invention.

What I claim is:

1. A boot sole structure for stiffening the sole (12, 55) of a boot (10, 51) in an arch area (14) of the sole between heel (17) and toe (18) portions thereof, the structure comprising: a bracket assembly (15) including at least two bearing members (31/32; 31, 32/35; 31, 32/35, 35), braced against corresponding support surfaces (23, 24) on respective opposed supporting portions (20, 22) of the sole, which surfaces at least partly flank the arch area, said members having respective contact surfaces (37, 38) thereon, and means (34, 36, 36') for interlocking one of said members in its assembled condition with respect to at least one other member.

2. The boot sole structure as defined in claim 1, wherein said interlocking means (34, 36, 36') are at least partly removable from at least one of said bearing members (31 . . . 35).

3. The boot sole structure as defined in claim 1, wherein at least one of said bearing members (31 . . . 35) is moveably interconnected with at least one other bearing member, whereby an at least partial displacement of said interlocking means (34, 36, 36') permits selective removal and attachment of said bracket assembly (15) from and to the sole (12, 55).

4. The boot sole structure as defined in claim 1, wherein said at least two bearing members (31 . . . 35) have at least one pair of said contact surfaces (37, 38) thereon, in slidable but mutually substantially opposed directions, which allow the bracing of said members against said support surfaces (23, 24) when said members are interlocked as aforesaid.

5. The boot sole structure as defined in claim 1, wherein said at least two bearing members (31 . . . 35) have profiled end portions (39), and at least one of the latter, and of complementary terminal portions of said support surfaces (23, 24), are formed with at least partly complementary curved engaging surfaces.

6. The boot sole structure as defined in claim 1, wherein said support surfaces (23, 24) are inclined relative to the surface of the sole (12, 55).

7. The boot sole structure as defined in claim 1, wherein said bracket assembly (15) includes said bearing members in the form of at least one central bracket member (35) and two longitudinally engageable bearing brackets (31, 32).

8. The boot sole structure as defined in claim 1, wherein said bracket assembly (15) includes a pair of interconnectable bearing brackets (31, 32) that form said bearing members.

9. The boot sole structure as defined in claim 8, wherein said bearing brackets (31, 32) have longitudinally engageable protrusions.

10. The boot sole structure as defined in claim 8, wherein said bearing brackets (31, 32) are transversely disposed with respect to said support surfaces (23, 24), which latter flank the arch area (14) in the sole (12, 55).

11. The boot sole structure as defined in claim 1, wherein a central one (35) of said bearing members has adjusting means for securing the same in two distinct, longitudinally spaced-apart operative positions with respect to said support surfaces (23, 24) by the use of said interlocking means (34, 36, 36'), whereby an auxiliary attachment (45/48, 59) can be secured selectively in one of the two operative positions with respect to the boot (51).

12. A boot sole structure for stiffening the sole (12, 55) of a boot (10, 51) in an arch area (14) of the sole between heel (17) and toe (18) portions thereof, the structure comprising: a bracket assembly (15) including three bearing members (31, 32/35), braced against corresponding support surfaces (23, 24) on respective opposed supporting portions (20, 22) of the sole, which surfaces at least partly flank the arch area, said members having respective contact surfaces (37, 38) thereon, and means (34, 36, 36'), for interlocking one of said members in its assembled condition with respect to at least one other member, wherein said three bearing members have at least one pair of said contact surfaces thereon, in pivotable but angularly different directions, which allow the bracing of said members against said support surfaces when said members are interlocked as aforesaid.

13. A boot sole structure for stiffening the sole (12, 55) of a boot (10, 51) in an arch area (14) of the sole between heel (17) and toe (18) portions thereof, the structure comprising: a bracket assembly (15) including at least two bearing members (31/32; 31, 32/35; 31, 32/35, 35), braced against corresponding support surfaces (23, 24) on respective opposed supporting portions (20, 22) of the sole, which surfaces at least partly flank the arch area, said members having respective contact surfaces (37, 38) thereon, and means (34, 36, 36') for interlocking one of said members in its assembled condition with respect to at least one other member, wherein said support surfaces are wider in at least one area than in other areas, for securely gripping said bracket assembly therebetween.

14. A boot sole structure for stiffening the sole (12, 55) of a boot (10, 51) in an arch area (14) of the sole between heel (17) and toe (18) portions thereof, the structure comprising: a bracket assembly (15) including two pairs of bearing members (31, 32/35, 35), braced against corresponding support surfaces (23, 24) on respective opposed supporting portions (20, 22) of the sole, which surfaces at least partly flank the arch area, said members having respective contact surfaces (37, 38) thereon, and means (34, 36, 36') for interlocking one of said members in its assembled condition with respect to at least one other member, wherein said pairs of bearing members are in the form of two bracket members (35) and two longitudinally engageable bearing brackets (31, 32), said bracket members straddling said bearing brackets while said brackets partly protrude from between said bracket members.

15. A boot sole structure for removeably attaching to the sole (12, 55) of a boot (51) at least one auxiliary attachment (45/48, 59) in an arch area (14) of the sole between heel (17) and toe (18) portions thereof, to adapt the boot for particular uses, the structure comprising: a bracket assembly (15) including at least two bearing members (31/32; 31, 32/35; 31, 32/35, 35), braced against corresponding support surfaces (23, 24) on respective opposed supporting portions (20, 22) of the sole, which surfaces at least partly flank the arch area, said members having respective contact surfaces (37, 38) thereon, and means (34, 36, 36') for interlocking one of said members in its assembled condition with respect to at least one other member.

* * * * *

UNITED STATES PATENT OFFICE

CERTIFICATE OF CORRECTION

PATENT NO. : 4,026,045

DATED : May 31, 1977

INVENTOR(S) : Barry L. Druss

It is certified that error appears in the above-identified patent and that said Letters Patent are hereby corrected as shown below:

Column 6, line 13, change "toes area" to -- toe areas --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*